US005722747A

United States Patent [19]

Baron

[11] Patent Number: 5,722,747

[45] Date of Patent: Mar. 3, 1998

[54] MERCHANDISING DISPLAY

[75] Inventor: Peter Baron, Waterloo, Australia

[73] Assignee: Australian Slatwall Industries Pty Ltd, Waterloo, Australia

[21] Appl. No.: 598,198

[22] Filed: Feb. 7, 1996

[30] Foreign Application Priority Data

Feb. 10, 1995 [AU] Australia ..... PN1057

[51] Int. Cl.[6] ..... A47B 81/00; A47B 97/00

[52] U.S. Cl. ..... 312/223.5; 312/114; 312/224; 362/125

[58] Field of Search ..... 312/223.5, 114, 312/117, 224; 362/125, 328, 307; 40/560, 442

[56] References Cited

U.S. PATENT DOCUMENTS

| | | | |
|---|---|---|---|
| 3,032,905 | 5/1962 | Schultz | 312/224 |
| 4,507,714 | 3/1985 | Aschinger et al. | 362/125 |
| 4,914,342 | 4/1990 | Mujahid et al. | 362/307 |
| 4,939,625 | 7/1990 | Olson | 312/223.5 |
| 5,123,192 | 6/1992 | Hsieh | 40/560 |
| 5,161,880 | 11/1992 | Azuma | 362/307 |
| 5,180,222 | 1/1993 | Robinson | 312/223.5 |

FOREIGN PATENT DOCUMENTS

| | | | |
|---|---|---|---|
| 2536649 | 6/1984 | France | 312/223.5 |

*Primary Examiner*—Peter M. Cuomo
*Assistant Examiner*—Anthony D. Barfield
*Attorney, Agent, or Firm*—Colin P. Abrahams

[57] ABSTRACT

This invention concerns a merchandising display, and in particular an eye level display incorporating internal lighting. The display provides an eye-level merchandising unit, comprising a stage (2) on which to place product (3). A light source (10) is situated below the front of the stage (2) to illuminate product placed at the front of the stage. A transparent screen (12.13) is positioned in front of the light source to allow forward illumination, and signage (14) will often be associated with the transparent screen. A reflector (5) is placed above the front of the stage to reflect light from the light source in the forward direction.

13 Claims, 2 Drawing Sheets

MERCHANDISING DISPLAY

TECHNICAL FIELD

This invention concerns a merchandising display, and in particular an eye level display incorporating internal lighting.

BACKGROUND OF THE INVENTION

Merchandising displays typically comprise shelves along which merchandise is stacked. Sometimes the shelves are sloped downwards so that merchandise automatically advances to the front of the display as items are selected and removed. Signage is usually attached to the front of the display, often at the front of each shelf. The shelves, merchandise and signage are usually illuminated by the shop's light fittings.

Another type of display, often used for high cost merchandise such as jewellery, is built into a countertop, and will often include internal lighting along the top edges of the cabinet in order to shed light down on to the merchandise.

SUMMARY OF THE INVENTION

The present invention, as currently envisaged, provides an eye-level merchandising unit, comprising a stage on which to place product. A light source is situated below the front of the stage to illuminate product placed at the front of the stage. A transparent screen is positioned in front of the light source to allow forward illumination, and signage will often be associated with the transparent screen. A reflector is placed above the front of the stage to reflect light from the light source in the forward direction.

This arrangement provides forward projecting illumination from above and below the product, and dramatic lighting effects to be played up on to the product from the light source. It may be enhanced by the provision of a diffusing screen between the light source and product placed at the front of the stage. Typically this diffusing screen will extend from the top of the transparent screen to the front of the stage. The diffusing screen will advantageously be manufactured as one piece with the clear transparent screen, and the transparent section may comprise two parallel leaves which can be separated in order to allow for the introduction of graphics material. The entire assembly of the transparent leaves and diffusing screen may be removable as a single piece in order to service the light source.

The overhead reflector is ideally oriented at 60° to the horizontal, in order to reflect light travelling up from the light source, forwards. The reflector will typically comprise a transparent screen backed by signage or other graphics material.

A second mirror may be provided between the light source and the front of the stage, and oriented in order to reflect light onto the front of the product. This mirror will typically be oriented at 45° to the horizontal.

Dividers may be provided, extending from the front to the back of the stage, to separate items of stock, or rows of stock, one from another. The dividers may be made of transparent material, and may be arranged in order that light will enter along their front edge so that they appear to glow. Transparent walls may be provided along each side of the display, and the overhead reflector may be connected between those two walls. In a preferred form the dividers and walls are made of plastics material, but are tinted slightly so that the edges look green and have the appearance of glass.

The merchandising displays may be stackable so that they can be mounted one upon another in order to form a column of displays. The displays are also advantageously demountable so that they may be sold in flatpacks.

BRIEF DESCRIPTION OF THE DRAWINGS

The invention will now be described, with reference to the accompanying drawings, in which.

BEST MODES FOR CARRYING OUT THE INVENTION

Figure 1:
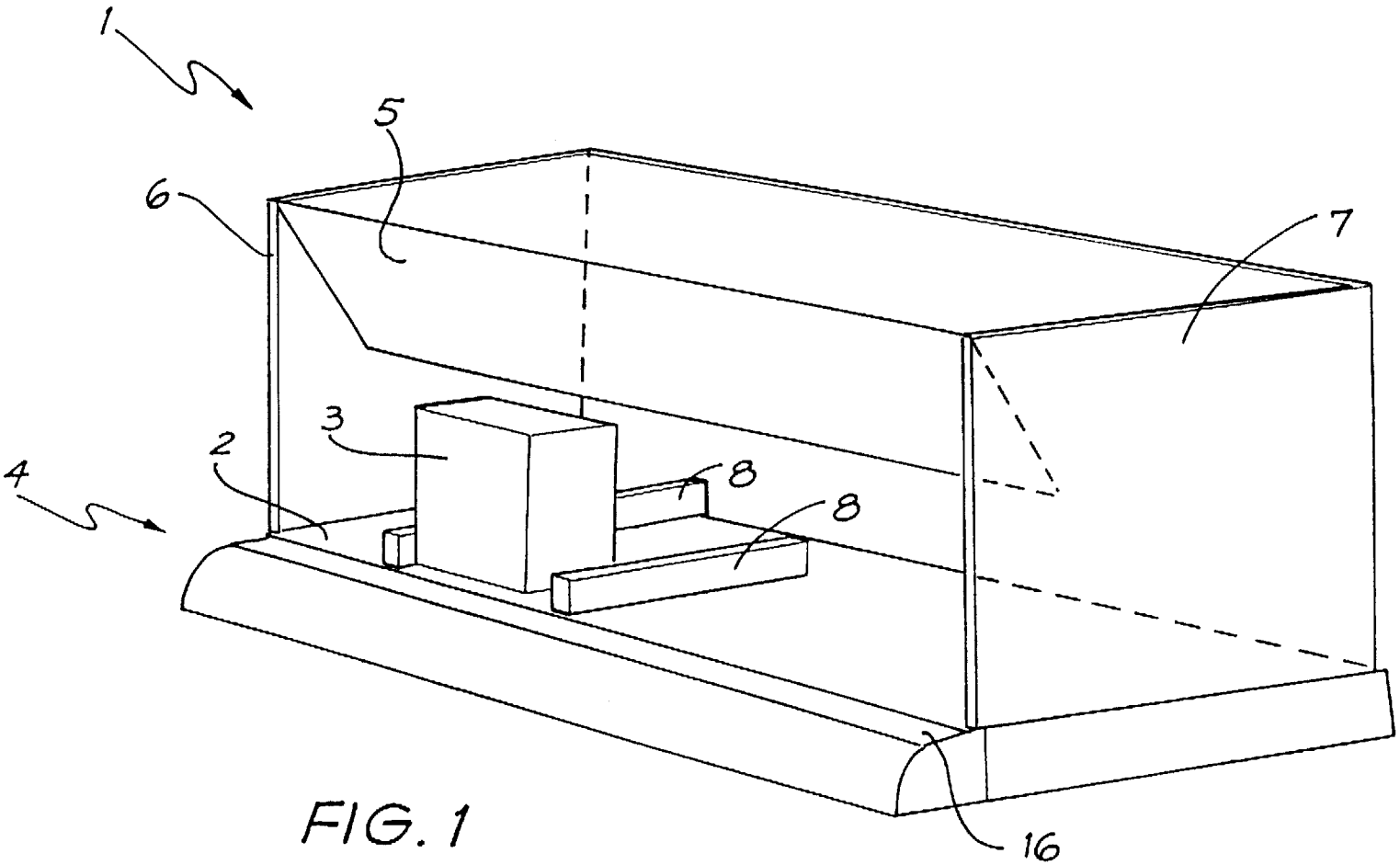
FIG. 1 is a pictorial view of a display embodying the present invention.
Figure 2:
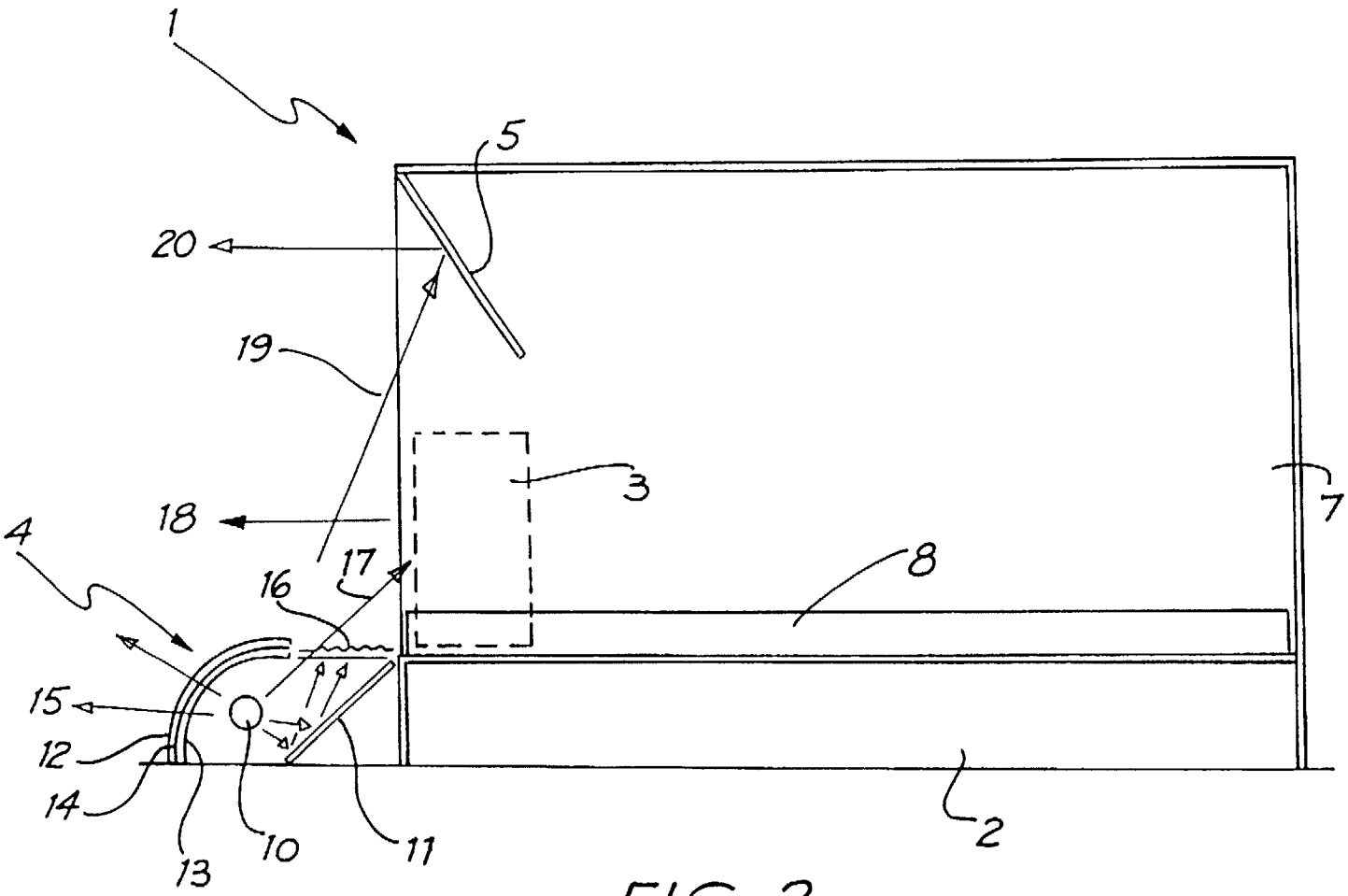
FIG. 2 is a side elevation of the display of FIG. 1.

Display 1 comprises a stage 2 on which product 3 may be positioned. A light housing indicated generally at 4 extends below the front of the stage, and an overhead reflector 5 is positioned above the front of the stage. Overhead reflector 5 is mounted between side walls 6 and 7.

Light housing 4 has a horizontal fluorescent tube 10 and a mirror 11 arranged at 45° extending from the front of the stage to the bottom of housing 4. The curved front of housing 4 is transparent, and comprises twin leaves 12 and 13 between which graphics material 14 is, in use, positioned. Light will shine from light source 10 through the twin transparent leaves 12 and 13 and the graphics material 14. The graphics material may include coloured transparent parts and opaque parts in order to create an attractive display.

On the top of light housing 4 is a diffuser 16, which diffuses light rays 17 travelling up from light source 10 to product 3 to provide dramatic illumination of the product. Light is reflected from the product in a general horizontal direction 18 to be observed by potential customers. Light also travels up from light source 10 in a direction indicated by arrow 19 to strike reflector 5 and be reflected in a forwards direction indicated by 20. Reflector 5 will typically comprise a transparent acrylic sheet backed with graphics material in order to provide a reflective display to potential customers.

Light will also travel from light source 10 to strike mirror 11 and be reflected up on to product 3 and to reflector 5 in order to increase the efficiency of illumination.

Internal dividers 8 may be provided within the display to separate individual items 3 of stock, or rows stock one from another. The side wall 6 and 7 and the internal dividers 8 are made of acrylic material and are transparent in order that light will enter their front edges so that they will glow. They are slightly tinted so that they appear green when seen from the edge and resemble glass.

Although the invention has been described with reference to a particular embodiment it should be appreciated that it may be embodied in many other forms to provide essential features of transmitting light forward, projection light up onto the product, and reflecting light forward above the product source.

I claim:

1. An eye-level merchandising unit, comprising:

a stage for receiving a product, the stage having a front and a back;

a light source situated below and in front of the stage;

a first screen extending from the front of the stage above the light source and allowing illumination from the light source rearwardly and upwardly onto the stage;

a second screen positioned in front of the light source to allow forward illumination;

an overhead reflector placed above the front of the stage to reflect light from the light source in the forward direction; and a second reflector provided between the light source and the front of the stage, and oriented in order to reflect light upwardly and rearwardly through the first screen onto the stage.

2. A merchandising unit according to claim 1, wherein said first screen is a diffusing screen.

3. A merchandising unit according to claim 1, wherein the first screen diffuses the light passing through it.

4. A merchandising unit according to claim 1, wherein the first screen and the second screen are manufactured as one piece.

5. A merchandising unit according to claim 1, wherein the second screen comprises two parallel transparent leaves which can be separated in order to allow for the introduction of graphics material.

6. A merchandising unit according to claim 1, wherein the overhead reflector is oriented at 60° to the horizontal in order to reflect light travelling up from the light source, forwards.

7. A merchandising unit according to claim 6, wherein the overhead reflector comprises a transparent screen backed by graphics material.

8. A merchandising unit according to claim 1, wherein the second reflector is oriented at 45° to the horizontal.

9. A merchandising unit according to claim 1, further comprising dividers extending from the front of the stage to the back of the stage for separating items of stock, one from another.

10. A merchandising unit according to claim 9, wherein the dividers are made of transparent material, and are arranged in order that light will enter along their front edge so that they appear to glow.

11. A merchandising unit according to claim 9, further comprising a pair of side walls separated by the stage, the overhead reflector being connected between the pair of side walls.

12. A merchandising unit according to claim 10, wherein the dividers and walls are made of plastics material, and are tinted slightly so that the edges look green and have the appearance of glass.

13. A merchandising unit according to claim 1, wherein at least one merchandising unit can be mounted upon another identical unit thereby forming column of displays.

* * * * *